United States Patent [19]

Bromley et al.

[11] 4,381,864

[45] May 3, 1983

[54] ELECTRONIC BASEBALL GAME METHOD AND APPARATUS

[75] Inventors: Eric Bromley, West Simsbury; Thomas Helmer, Lebanon, both of Conn.

[73] Assignee: Coleco Industries, Inc., Hartford, Conn.

[21] Appl. No.: 150,440

[22] Filed: May 16, 1980

[51] Int. Cl.[3] ..... A63F 9/00

[52] U.S. Cl. ..... 273/88; 273/85 G

[58] Field of Search ..... 273/85 G, 86 R, 88, 273/94, 313, 1 E, 1 GC, 1 GE; 364/410; 340/323 R; 235/92 GA

[56] References Cited

U.S. PATENT DOCUMENTS

| | | | |
|---|---|---|---|
| 1,943,685 | 1/1934 | Mayorga | 273/88 |
| 2,258,272 | 10/1971 | Alexander | 273/88 |
| 2,769,639 | 11/1956 | Seale . | |
| 2,825,564 | 3/1958 | Macht et al. . | |
| 3,655,189 | 4/1972 | Alexander | 273/88 |
| 3,860,239 | 1/1975 | Feuer et al. | 273/88 |
| 4,195,838 | 4/1980 | Santandrea | 273/88 |
| 4,240,632 | 12/1980 | Watanabe | 273/88 |
| 4,240,633 | 12/1980 | Watanabe | 273/88 |
| 4,324,402 | 4/1982 | Klose | 273/88 |
| 4,326,715 | 4/1982 | Ito et al. | 273/88 |

OTHER PUBLICATIONS

*Mattel Electronics ®Baseball Instructions;* 1978; pp. 1–14.

*Primary Examiner*—Vance Y. Hum

[57] ABSTRACT

An electronic game that simulates the game of baseball incudes a switch for signaling the occurrence of a batter swing as well as further switches for indicating the type of swing to be simulated. The outcomes of batter swings are determined on a probabilistic basis, and the probability of a safe hit when the swing type represents a "power" swing is always less than the probability of a safe hit when an ordinary swing is simulated. However, safe hits are more likely to occur as multiple base hits if they result from a "power" swing than if they result from an ordinary swing. Provision is also made for the simulation of ball and strike paths and attempted steals, and provision is further made for "tagging up" and stealing upon the simulation of some types of fly outs.

16 Claims, 10 Drawing Figures

ELECTRONIC BASEBALL GAME METHOD AND APPARATUS

BACKGROUND OF THE INVENTION

The present invention relates to the field of electronic games, specifically games of the type that simulate baseball.

It is desirable in game devices for simulating athletic contests that they provide the operator with a sense of playing the game by requiring actions that are analogous to those that he would take if he were playing the real game. Consequently, devices for simulating the game of baseball have employed numerous ways of simulating batting. The most apparent way to simulate batting is exemplified in the pinball-type games, in which a mechanical lever controlled by the operator pivots in an attempt to hit an actual rolling ball. This type of game has the advantage that the operator performs a realtime function that is similar to the swinging action that a batter actually performs, but the mechanical, moving parts used to display the action are not desirable in all types of games. Furthermore, most examples of this type of game only permit the operator to choose the time at which the swing is to be performed, not the force of the swing.

Other types of games avoid the use of a moving ball and a lever; instead, they determine the outcome of a simulated swing in a somewhat random manner. This type of game is exemplified by the board game illustrated in U.S. Pat. No. 2,825,564 to Macht et al., which simulates a choice by the operator of the type of swing that is to be performed. The Macht et al. apparatus uses a spinner to determine swing outcome, so the operator does not time the swing in a real-time fashion, and the choices of swing type, although not so named, are in essence guesses at the type of pitch selected by the defensive operator. Although this type of game does simulate some of the features of baseball, it is clear that the action in this game is somewhat removed from the action of the batter in the real game.

The advance of technology has brought electricity into this game field, and the early electrical games are exemplified by the device illustrated in U.S. Pat. No. 3,655,189 to Alexander. In that game, numerous relay-controlled circuits determine the outcome in a pseudo-random manner based on the guesses of the offensive operator at the type of pitch selected by the defensive operator. Depending on the match up, different outcome probabilities are chosen.

Further advances have resulted in electronic games for simulating baseball. An example of such a device is described in U.S. Pat. No. 3,860,239 to Feuer et al. In the Feuer device, the outcome of a simulated swing is determined by the time at which the key actuation representing the swing occurs.

Despite these many attempts at simulating the game of baseball, none has effectively simulated the results of swinging particularly hard in an attempt to hit a long ball. It is therefore an object of the present invention to simulate this action. It is a further object to provide this simulation by means of an electronic device that determines outcomes in a manner that is random at least in appearance.

SUMMARY OF THE INVENTION

The foregoing and related objects are achieved in an apparatus for simulating a baseball game. The apparatus includes a display panel including a visual simulation of a baseball field and is adapted, upon application of electrical signals thereto, to display symbols including a ball symbol for simulating a ball and to indicate outcomes of simulated batter swings at the simulated ball. The possible outcomes includes base hits and multiple base hits. The possible outcomes thereby include outcomes representing batted balls. A control board is provided that includes a multiplicity of manually operable control elements and is operable by operation of at least one of the manually operable control elements to generate signals signifying simulated batter swings at the simulated ball. At least one of the control elements is manually operable to provide variation between generated signals and thus indicate a choice of the type of batter swing being simulated. The choice is between at least a first type of batter swing and a second type of batter swing.

The game further includes operational circuit means operatively connected to the display panel for generation and transmission of electrical signals to the display panel to display the ball symbol and indicate the outcome of simulated batter swings at the simulated ball. The operational circuit means is electrically connected to the control board for reception therefrom of the electrical signals signifying simulated batter swings at the simulated ball and indicating which type of batter swing is being simulated. The operational circuit means includes means for moving the ball symbol along the simulated playing field to simulate a pitch. It also includes means for detecting the time during the simulated movement of the pitched ball at which the swing-signifying signal is received. A means is included for establishing probabilities for the possible outcomes of the simulated batter swing. The probabilities are dependent on at least one modifying factor. One modifying factor upon which the probabilities are dependent is the type of batter swing being simulated. If all other modifying factors are the same, the probability that a simulated hit will result from the first type of simulated batter swing is always greater than the probability that a simulated hit will result from the second type of simulated batter swing. But the ratio, if all other modifying factors are the same, of the probability of a simulated multiple base hit to that of a simulated base hit is greater for the second type of simulated batter swing than for the first type. The operational circuit means also includes means for determining the outcome to be displayed on the display panel in response to signals from the operational circuit means. The determination is made in a manner dependent at least on the detected time during the simulated movement of the pitched ball when the simulated batter swing occurs, and the outcome within at least a range of swing times is determined for at least some simulated batter swings in a variable manner in accordance with the probabilities established by the means for establishing probabilities.

The possible outcomes of simulated batter swings preferably also include outcomes representing other than batted balls. The means for detecting swing times establishes a time window within the time of the simulated movement of the pitched ball and determines whether the swing-signifying signal is received during the time window, and the outcome-determining means determines outcomes representing batted balls only if the swing-signifying signal is detected by the swing-detecting means during the time window.

The means for moving the ball symbol to simulate the pitch may include means for moving the ball symbol along at least one simulated strike path and means for moving the ball symbol along at least one simulated ball path. The outcome-determining means would determine outcomes representing batted balls only when the means for moving the ball symbol moves the ball symbol along a simulated strike path. Preferably, the the means for moving the ball symbol to simulate a pitch is operable to select from among the simulated strike and ball paths in a variable manner.

In the preferred embodiment, the control board is operable by operation of at least one of the manually operable control elements to generate and transmit to the operational circuit means a signal representing the selection of a given one of the simulated strike and ball paths, and the means for moving the ball symbol to simulate a pitch moves the ball symbol to simulate the given one of the simulated strike and ball paths in response to receipt by the operational circuit means of the signals from the control board representing the selection of the given one of the simulated strike and ball paths.

The display panel may conveniently be adapted, upon application of electrical signals to it, to display symbols to represent the positions of base runners on the simulated baseball field. The control board would be operable by operation of at least one of the manually operable control elements to generate and transmit to the operational circuit means signals representing steal commands, and the operational circuit means would generate and transmit to the display panel electrical signals to display symbols to represent the positions of base runners on the simulated baseball field. It would further include steal means operable upon reception by the operational circuit means of the signals representing steal commands to determine whether a successful steal is to be simulated and to advance the position of a simulated base runner on the simulated baseball field when it has determined to simulate a successful steal. The steal means would preferably determine whether the simulated steal is successful in a variable manner in at least some play situations.

In the preferred embodiment, at least one of the possible outcomes of simulated batter swings includes a simulated fly out, and the steal means include means for establishing a time window in at least some play situations when a fly out has been indicated and for simulating an attempt to take a base if the operational circuit means receives the signal from the control board representing an attempt to take a base within the time window established by the steal means.

The objects are also achieved in an apparatus for simulating a baseball game that includes a display panel including a visual simulation of a baseball field and adapted, upon application of electrical signals thereto, to display symbols including a ball symbol for simulating a ball, to indicate outcomes of simulated batter swings at the simulated ball, and to display a representation of probability data associated with a simulated batter whose turn at bat is currently being simulated. A control board including a multiplicity of manually operable control elements is also included. It is operable by operation of at least one of the manually operable control elements to generate signals signifying simulated batter swings at the simulated ball. At least one of the control elements is manually operable to provide a variation between generated signals indicative of a choice of the type of batter swing being simulated. An operational circuit means is operatively connected to the display panel for generation and transmission of electrical signals to the display panel to display the ball symbol, to display a represention of probability data associated with the simulated batter whose turn at bat is currently being simulated, and to indicate the outcomes of simulated batter swings at the simulated ball. The operational circuit means is electrically connected to the control board for reception therefrom of the electrical signals signifying simulated batter swings and indicating which type of batter swing is being simulated. The operational circuit means includes memory circuit means containing probability data associated with a plurality of batters to be simulated and means for designating the one among the plurality of simulated batters whose turn at bat is to be simulated and a presentation of whose probability data is to be displayed. It also includes means for moving the ball symbol along the simulated playing field to simulate a pitch and means for detecting the time during the simulated movement of the pitched ball at which the swing-signifying signal is received.

A number-generating means is included in the operational circuit means for establishing at least one outcome-determining numerical value in a variable manner. Finally, the operational circuit means includes means for determining the outcome to be displayed on the display panel. This determination is made in a manner dependent at least on the detected time during the simulated movement of the pitched ball at which the swing-signifying signal is received, and the outcome within at least a range of swing times is determined for at least some simulated batter swings by interpreting at least one of the outcome-determining numerical values as the outcome of the currently simulated batter swing. The interpretation of the outcome-determining numerical value depends at least on the choice of batter swing and on the probability data associated with the simulated batter whose turn at bat is currently being simulated.

The outcome-determining means may conveniently interpret the outcome-determining numerical value by establishing a comparison numerical value equal to the probability data associated with the simulated batter whose turn at bat is currently being simulated when a first type of batter swing has been chosen and differing from the probability data by a predetermined amount when at least one other type of batter swing has been chosen. The outcome-determining means compares the comparison numerical value to the outcome-determining numerical value and selects between sets of outcomes based on the difference between the comparison numerical value and the outcome-determining numerical value.

In the preferred embodiment, the pitch-simulating means moves the ball symbol along the simulated playing field at a speed chosen from among a plurality of speeds in accordance with at least one number generated by the number-generating means. The control board is operable by operation of at least one of the manually operable control elements to generate and transmit speed-selection signals to the operational circuit means to select from among sets of speeds for simulating pitches, and the pitch-simulating means selects a pitch speed from the set of pitch speeds selected by the speed-selection signals from the control board.

There is also disclosed a method of electrically simulating a baseball game. It includes the step of providing a display panel that has a visual simulation of a baseball field and is adapted, upon application of electrical signals to it to display symbols including a ball symbol for simulating a ball, to display a representation of probability data associated with a simulated batter selected from among a plurality of batters to be simulated, and to indicate outcomes of simulated batter swings at the simulated ball. It also includes the steps of providing memory circuit means containing probability data associated with a plurality of batters to be simulated, designating one among the plurality of batters to be simulated as the one whose turn at bat is currently to be simulated, and generating and transmitting to the display panel electrical signals to display on the display panel a representation of the probability data associated with the batter whose turn at bat is currently being simulated. These steps are accompanied by the steps of generating and transmitting electrical signals to the display panel to display a ball symbol and to move the ball symbol along the simulated playing field to simulate a pitch, electrically signifying the occurrence of a simulated batter swing and a choice of the type of swing being simulated, detecting the time during the simulated movement of the pitched ball at which the simulated swing is electrically signified, and establishing at least one outcome-determining numerical value in a variable manner. The outcome of the simulated batter swing is determined in a manner dependent at least on the detected time during the simulated movement of the pitched ball at which the simulated batter swing is electrically signified. The outcome within at least a range of swing times is determined by interpreting at least one outcome-determining numerical value as the outcome of the simulated batter swing. This interpretation depends at least on both the choice of batter swing and the probability data associated with the simulated batter whose turn at bat is currently being simulated. The method finally includes generating and transmitting signals to the display panel to display the determined outcome.

The outcomes that the display panel is adapted to display would typically include outcomes representing a batted ball, and the step of detecting the swing time would include establishing a time window within the pitch simulation and determining whether the simulated swing is electrically signified during the time window. The outcome-determining step would include determining an outcome representing a batted ball only when the swing time occurs within the time window.

Preferably, the step of generating and transmitting signals to the display panel to simulate a pitch is performed a plurality of times and includes simulating a pitch at least once along a simulated strike path and at least once along a simulated ball path, and the outcome-determining step includes determining an outcome representing a batted ball only when a pitch is simulated along a simulated strike path.

In the preferred embodiment, the step of electrically signifying a choice of swing type includes signifying one of at least a first type and a second type of swing. In this embodiment, the step of determining the outcome of the simulated batter swing includes establishing a comparison numerical value that is equal to the probability data associated with the simulated batter whose turn at bat is currently being simulated if the first swing type is chosen; the comparison numerical value is equal to a numerical value differing by a predetermined amount from the probability data associated with the currently simulated batter if the second swing type is chosen. The preferred embodiment of the step of determining the outcome further includes the steps of dividing the possible outcomes of a batter swing that represent a batted ball into first and second sets, comparing the comparison numerical value with the outcome-determining numerical value, and selecting an outcome from the first set of outcomes if a given one of the comparison and outcome-determining numerical values is greater than the other and selecting an outcome from the second set if it is not.

BRIEF DESCRIPTION OF THE DRAWINGS

These and further features and advantages of the present invention are described with references to the accompanying drawings, in which.

DETAILED DESCRIPTION OF THE PREFERRED EMBODIMENT

Figure 1:
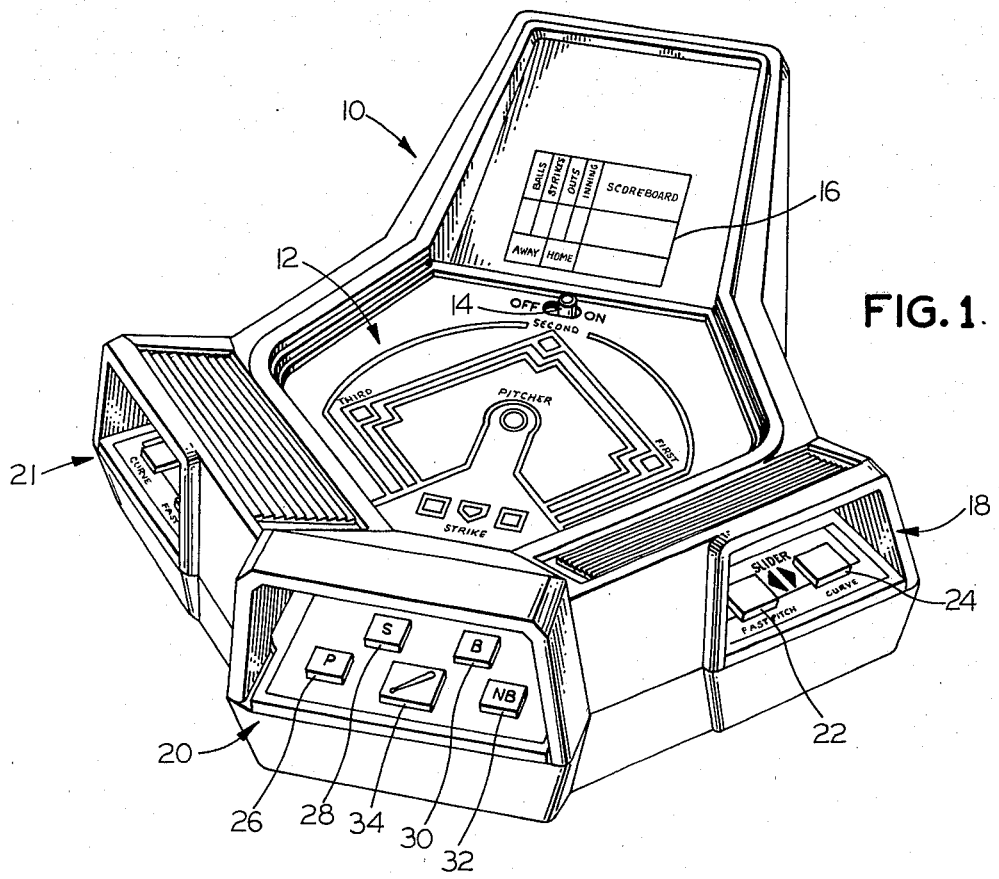
FIG. 1 is a perspective view of an apparatus employing the teachings of the present invention.

FIG. 1 is a perspective view of an electronic game for simulating the game of baseball. By depressing buttons on a defensive portion 18 of the control board, a defensive operator can select the type of pitch to be simulated on a portion 12 of the game display that has a visual simulation of a baseball field. An offensive portion of the control board 20 is provided with buttons that an offensive player can employ to simulate the swinging of the bat and indicate the strength of the simulated swing. Quite a realistic simulation of variation in swing strength is provided because, unlike some games, the illustrated game allows a selection of swing types that is not merely an attempt to guess the type of pitch that is being simulated. The effect of choosing a power swing is always a greater probability of hitting long balls but a lower probability of achieving a hit.

The device depicted in FIG. 1 includes a housing sized for table-top operation, although it is clear that appropriate modifications would result in a hand-held game. In fact, the preferred embodiment is sufficiently small and light in weight that the game could be played in a hand-held manner, although that is not the intended mode of operation.

A display panel is provided that includes two portions, a playing-field simulation 12 and a score board 16. In addition to displaying the score, score board 16 also indicates the outcomes of various plays and provides further status-type information, such as the number of the inning.

An on/off switch 14 is provided in the field portion of the display. It is a three-position switch that is not only used to turn the game on and off but also to indicate the skill level at which the game is to be played.

The control board includes three portions 18, 20 and 21 and includes the various controls for actual play of the game. Portions 18 and 21 are defensive-operator portions. They are identical in function and are wired in parallel. The defensive-operator controls are duplicated so that the operators need not change positions at the beginning of every half inning. The offensive-operator portion 20 is centrally located and easily reached from both sides, so it is not duplicated.

Figure 2:
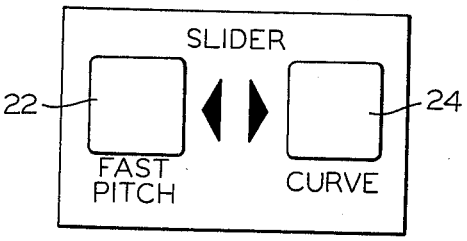
FIG. 2 is a detailed view of the portion of the control board used by the defensive operator.

FIG. 2 illustrates the layout of one of the defensive-operator portions 18 and 21 and discloses that each defensive-operator portion has two keys, a FAST PITCH key 22 and a CURVE key 24. The defensive operator can choose either one, both, or neither of keys 22 and 24, and the pitch subsequently simulated is influenced by the signals from keys 22 and 24. However, there is also a random—or apparently random—factor added into the pitch simulation, so it is only partially dependent on inputs from keys 22 and 24.

Figure 3:
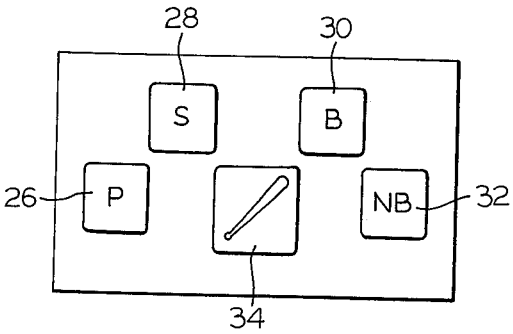
FIG. 3 is a similar view of the portion of the control board used by the offensive operator.

FIG. 3 illustrates the layout of the offensive-operator portion of the control board. The offensive operator is provided with five buttons. Keys 26, 28, 30 and 32 are provided with the legends P, S, V, and NB, respectively. Key 24 is provided with a picture of a bat.

The turn at bat of each simulated batter begins when the offensive operator depresses the NB (next batter) key. Prior to each pitch, the offensive operator may depress one or more of the B, S and P keys, whose labels stand for bunt, steal and power swing, respectively. A pitch is then simulated, and the offensive operator must depress swing key 34 when the "ball" crosses the "plate" if a batted ball is to result. Otherwise, a ball or strike will result, depending on factors further described below.

Figure 4:
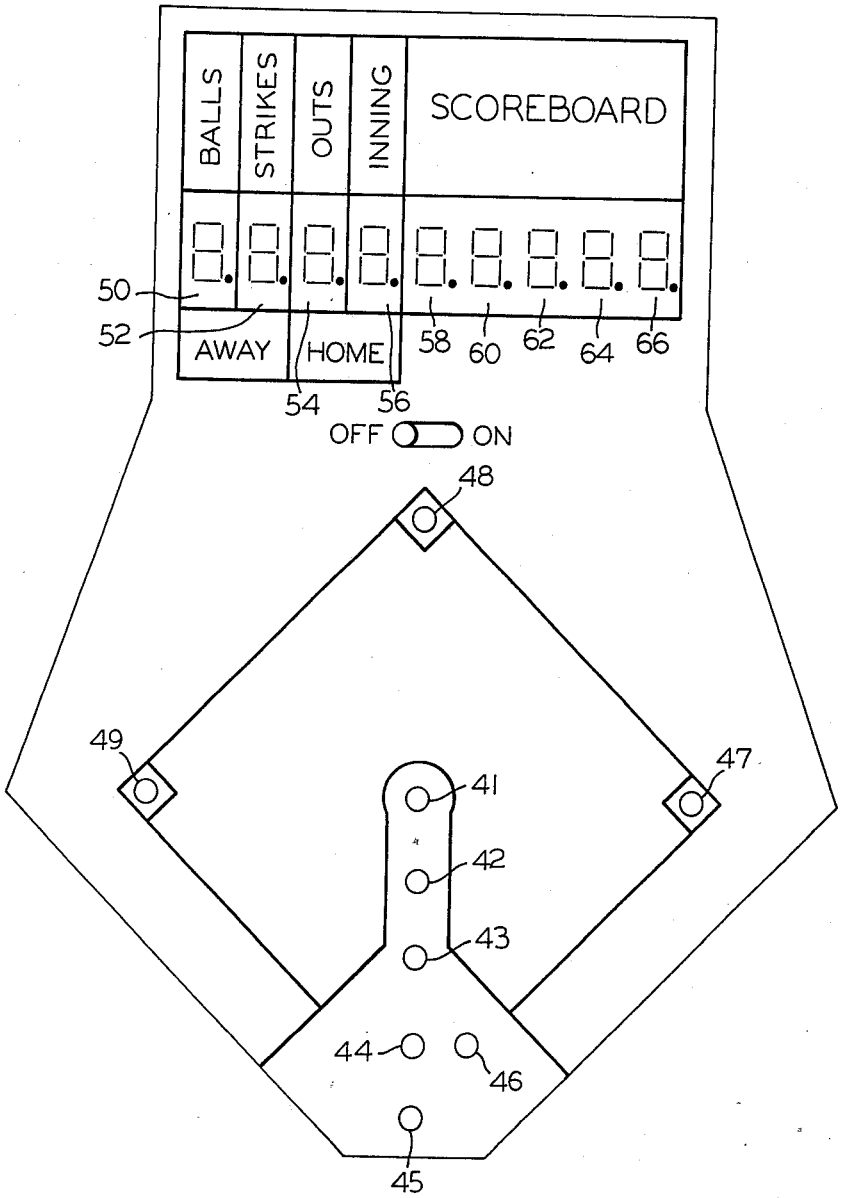
FIG. 4 is a layout of the various display devices employed for simulating play action and representing outcomes and status information.

FIG. 4 shows the layout of the various display devices that are used to display game action as well as outcomes of that action. Devices 41 through 46 are LEDs employed to simulate a pitched ball, and LED 44 has the further function of representing a base runner at home plate. LEDs 47, 48, and 49 are also used to simulate base runners at first, second and third bases, respectively. Various outcomes and status information are displayed on devices 50 through 66, which constitute a nine-digit vacuum-fluorescent display, each digit including seven segments plus a decimal point. Because such a nine-digit vacuum-fluorescent display is an easily obtained off-the-shelf item, nine display digits are provided, but only eight digits are actually used; digit 58 only spaces the portions of the display and is not functional.

The operation of the device begins when one of the operators moves on/off switch 14 to the middle, or Skill 1, position. In the alternative, the right, or Skill 2, position could be employed, in which case the game timing would be speeded up to make "hitting" the "ball" more difficult. Upon operation of switch 14, a speaker contained in the housing is caused to play "Take Me Out To The Ball Game," and display digits 50 to 56 and 60 to 66 flash all 8's. Then the display repetitively flashes the score (00 to 00) on display digits 50 to 56, and the letter A is flashed in display digit 66 to indicate that the away team is at bat. At the same time, two-tone audible signal is played to indicate to the offensive operator that he must depress the NB key to start the action. The signal and the flashing display continue until the NB switch is depressed, at which time the inning number and current number of balls, strikes, and outs are displayed steadily in display digits 50–56. Simultaneously, display digits 60–66 display the batting average of the currently simulated batter.

When the NB key is released, the display digits are extinguished, and LED 14 is illuminated, signifying the presence of the ball at the pitcher's mound.

LED 14 remains lit for around two or three seconds, during which time the operators can enter choices on their respective portions of the control board. For the sake of example, it will be assumed that the defensive operator depresses FAST PITCH key 22 and that the offensive operator makes no entry. By depressing FAST PITCH key 22, the offensive operator causes the controlling circuitry to choose a pitch speed from among four relatively fast pitch speeds. The faster speeds make it more difficult for the batter to hit the ball because he must react more quickly. On the other hand, the choice of a fast pitch reduces the likelihood that a pitch within the strike zone will be simulated.

It should be noted that there are three other choices that the offensive operator could make. The first is the operation of no key at all, which results in a pitch simulation at one of four speeds selected from a relatively slow range in an apparently random manner by the operational circuitry. Operation of the CURVE key alone guarantees that the pitch will be wide at one of the four slow speeds, while simultaneous operation of both the FAST PITCH and CURVE keys results in a pitch outside the strike zone delivered at one of the four fast speeds. This last option is the one to which the "slider" legend on the defensive portion of the control board refers.

After the two or three seconds during which LED 41 is lighted, simulation of the pitch is caused by successive illumination of LEDs 42, 43, 44 or 46, and, if a batted ball is not to be simulated, 45. LED 46 is lit to simulate a pitch that is wide, while the lighting of LED 44 means that the pitch is over the plate. The determination of which type of pitch will be simulated is described in more detail below. For present purposes, it will merely be observed that the pitch will always follow the ball path if the CURVE key is depressed, while either type of pitch can result if the CURVE key is not depressed.

As the pitch simulation proceeds, the batter attempts to depress swing key 34 during a time window that roughly corresponds to the time during which LED 44 is illuminated. Assuming that a pitch within the strike zone is simulated (i.e., that LED 44 is lit), a batted ball results if initial depression of key 34 occurs during this time window. If the swing key 34 is not operated during this window, or if key 34 is operated but the window does not occur because LED 46 instead of LED 44 is illuminated, then a strike is simulated. In a case in which the swing switch 32 is not operated at all, a ball will result if a wide pitch is simulated. LED 45 will light up if either a ball or a strike results.

In the current example, it is assumed that a fast pitch has been delivered over the plate but the offensive operator failed to depress key 34 during the required time window. LED 45 therefore lights up momentarily, and this illumination is followed by a display of the current number of balls, strikes, and outs, as well as the number of the inning, on display digits 50–56. Since the first pitch resulted in a strike, display digit 52 displays a 1.

After a brief display of this information, LED 41 again lights up to represent the presence of the ball at the pitcher's mound and indicate that the operational circuit will now accept signals entered from the control board. It is assumed that the defensive operator makes no entry this time but that the offensive operator has depressed the P button to indicate that he wishes to simulate a particularly hard ("power") swing. The result of the choice of a power swing is to reduce the likelihood of a successful outcome of a batted ball. A power swing is just as likely to result in a batted ball as an ordinary swing is, but a batted ball does not always result in a hit. A hit is less likely with a power swing, but a fly out or a ground out is more likely. For the sake of the present example, it is assumed that the offensive operator is successful in depressing swing key 34 during the required time window and that a batted-ball condition results because the ball is simulated as crossing the plate.

When the game has reached a batted-ball condition, the speaker emits a sharp sound representing the crack of a bat against a baseball, and a whistle sweeping up follows. If the operational circuitry has determined that the result of the batted ball is a hit, a "charge" tune is played. Otherwise, a whistle sweeping down follows the whistle sweeping up. This indicates that a fly out or ground out has occurred.

In the present example, it is assumed that the result of the batted ball is determined by the operational circuitry to be a base hit, so the "charge" tune is played. After the tune is finished, LED 47 lights to represent a runner on first base, and the portion of the display that includes display digits 60 through 66 reports the outcome. In this case, the code "1b" (base hit) is displayed on display digits 64 and 66. The other outcomes and their codes are as follows:

Fly out=FO
Ground out=GO
Single=1b
Double=2b
Triple=3b
Home run=Hr
Sacrifice bunt=SAC
Double play=dp
Walk=bb (base on balls)
Strike outs=SO Of the above, a sacrifice bunt can only result if the B key has been operated to simulate an attempted bunt. Also, a double play can only result if a base runner is already on base. Walks and stikeouts are listed, but they are not outcomes of a batted ball.

In addition to the previously mentioned sound effects, "Take Me Out To The Ball Game" would be played if the outcome were a home run. The "charge" tune is also played when a batter walks, while a signal descending in pitch occurs when a batter has struck out.

After the "1b" code has been displayed briefly, the operational circuitry automatically shifts to a flashing display of the score in display digits 50 through 56 and an A in display digit 66. The A indicates that the away team is still at bat. LED 47 also flashes to indicate the presence of a base runner on first base, and the repetitive two-note signal is played to alert the offensive operator to the requirement that he depress the NB key.

Depression of the NB key extinguishes the score and team display and displays the number of balls, strikes, and outs, the inning number, a new batting average, and the position of the base runner. The previous batting average displayed was 0.300, but with the new depression of the NB key, a 0.350 average is displayed. The game is arranged to simulate a lineup of nine players with displayed batting averages as follows:

| Player No. | Average |
|---|---|
| 1 | .300 |
| 2 | .350 |
| 3 | .350 |
| 4 | .400 |
| 5 | .350 |
| 6 | .300 |
| 7 | .250 |
| 8 | .250 |
| 9 | .200 |

The displayed batting averages represent the data stored in the circuitry for each simulated batter, but adjustments have been made because a real batter's batting average is based on the percentage of hits per time at bat, and not just the percentage of hits per batted ball. Furthermore, the actual average over time will depend on the skill of the human operator. To adjust in part for these factors, the ratios contained in the microprocessor circuitry are actually higher than the batting averages displayed. For instance, a "batter" whose displayed average is 0.200 actually has a 5/16 (=0.3125) chance of safely reaching base on a batted ball. A "batter" having a displayed average of 0.400 has a 9/16 (=0.5625) chance. Thus, the displayed averages represent the probability data contained in the microprocessor in a relative sense; they do not give the exact ratios contained in the microprocessor memory.

Release of the NB key again results in all display devices except LED 41 being extinguished. This again signifies the position of the ball on the mound and the readiness of the circuit to accept signals entered from the control board. It will be assumed that the offensive operator recognizes that he has no outs and that it would be advantageous to advance his base runner. He therefore depresses the B button. At the same time, the defensive operator depresses the CURVE button. The result of these switch depressions is that a wide pitch is simulated by successive illumination of LEDs 41, 42, 43, 46, and 45. The depression of swing key 34 accordingly results in a strike; a batted ball never results from a wide pitch. The display indicates a strike as before, and the ball is again returned to the pitcher's mound by illumination of LED 41.

This time the defensive operator chooses a fast pitch, the offensive operator again chooses a bunt, the ball is simulated as hitting the strike zone, and the offensive operates swing key 34 within the required time window. Unlike a regular or power swing, a bunt within the time window always has the same outcome; the base runner advances, while the batter is thrown out at first. The "SAC" code for a successful sacrifice bunt is displayed on display digits 62 through 66, and LED 48 is illuminated to represent advancement of the runner to second base. This display is followed by the score, the team code, and the runner position, all of which flash to the accompaniment of an audible signal alerting the offensive operator to the necessity for depressing the NB key.

When the offensive operator depresses the NB key, the batting average of the third simulated batter is displayed, and display digits 50 through 56 are illuminated to show the inning number and the number of balls, strikes and outs. LED 48 lights to show the runner on second base again, and display digit 54 displays a 1 to show that there is now one out because the batter was thrown out at first.

The offensive operator releases the NB key, and LED 41 lights up again to indicate that the operational circuit stands ready to receive information from the control board. At this point, the offensive operator depresses the S key, indicating that the runner on second will attempt to steal. At the same time, the defensive operator depresses the FAST PITCH key. When the time for entering signal has passed, then, a fast pitch is simulated. In this case, a ball following a strike path is simulated, and the batter swings and misses. Since the S key has been operated, the operational circuitry determines in an apparently random manner whether or not the lead runner (in this case, the only runner) will advance, and a "steal" sound effect is produced. In the present example, it will be assumed that the steal is successful. In the preferred embodiment, the steal is always unsuccessful if the pitch is simulated to have followed the ball path, so the defensive operator can prevent a steal by operating the CURVE key.

If, instead of missing, the batter had hit safely, then all runners (in this case, only the one runner) would have advanced one more base than the batter. If the result of the batted ball is a fly out, the runners do not advance.

A ground out causes all runners to advance one base, with the batter, of course, being thrown out at first. A base on balls results in cancellation of the steal command.

When LED 41 is again illuminated to indicate that the operational circuitry is ready to receive signals from the control board, the defensive operator enters no signals, but the offensive operator depresses the P key. As was described previously, this simulates a hard swing, which results in a lower likelihood of a safe hit but a higher likelihood of multiple bases if there is a safe hit. In this case, the batter connects, but the result of the batted ball is a fly out. This result is indicated by the "FO" code on display digits 64 and 66.

While the code is being displayed, the offensive operator depresses the S key. This causes it to be simulated that the runner on third tags up and runs to home. This option is only open to the offensive operator in the special situation in which he has attempted a power swing and a fly out has resulted. In this situation only, the offensive operator has the option of depressing the S key while the "FO" code is being displayed. If he does so, an attempt to take a base after tagging up will be simulated. In this case, the operational circuitry determines that the runner reaches home safely. The score display now flashes to show that the score is one to nothing, and LED 44 flashes with it to indicate that the runner has sucessfully reaches home.

On the next turn, the offensive operator again depresses the NB button, which causes LED 44 again to light up with the rest of the information. Three successive pitches are then simulated, and the batter swings and misses three times. Following the third strike, an audible signal descending in pitch indicates that the batter has struck out. This is followed by the "SO" code, which in turn is followed by a four-note audible signal indicating that the side has been retired. After this audible signal, the score of one to zero is again flashed, but display digit 66 flashes an H, rather than an A, because the home team is now at bat.

The previous defensive operator now becomes the offensive operator and enters signals from the offensive portion of the control board, while the erstwhile offensive operator employs the defensive portion of the control board that is in front of him. Play continues in this manner until nine innings have been completed. If the score is tied at the end of nine innings, the game goes into extra innings, the innings digit displaying a zero to indicate the tenth inning.

Figure 5:
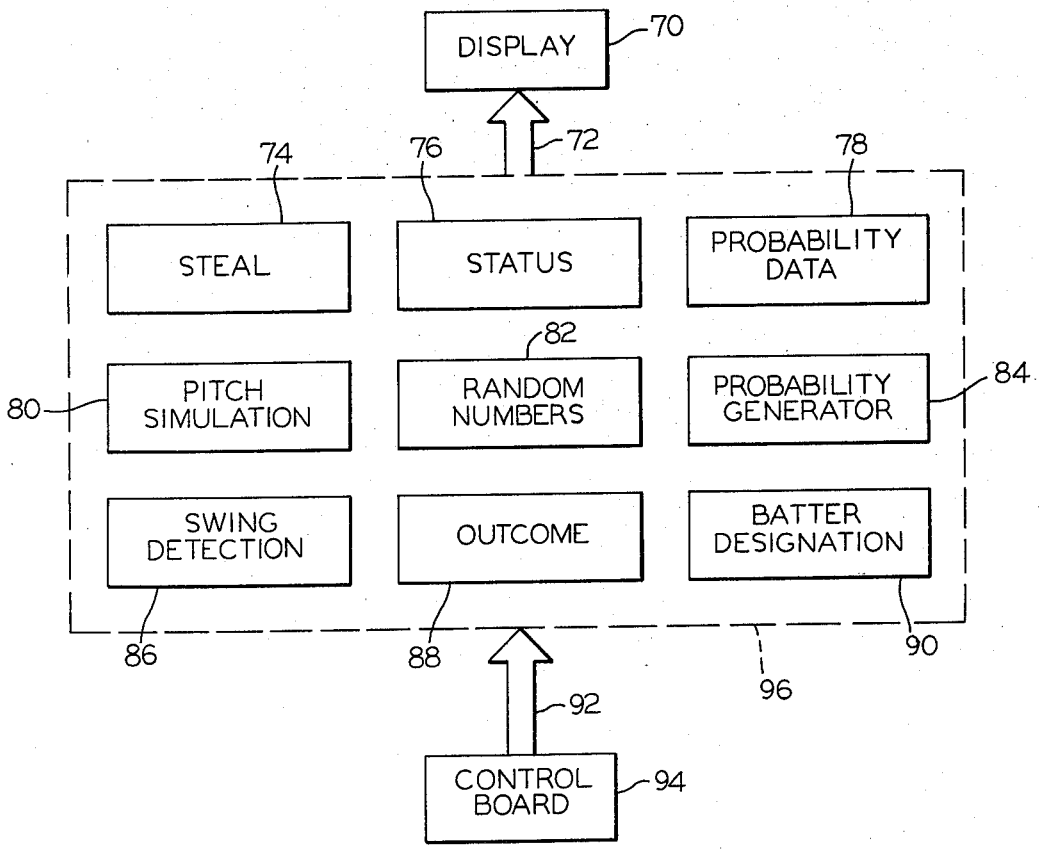
FIG. 5 is a block diagram representing the various functions provided by the apparatus.

The functions exemplified by the above description are suggested in block-diagram form in FIG. 5, which shows that an operational circuit, indicated by dashed lines 96, receives signals 92 from a control board 94. It in turn transmits signals 72 to display 70 in order to simulate the game action and indicate the outcomes. Operational circuit 96 provides a variety of functions represented by block 74 through 90. In the preferred embodiment, these functions are provided by a circuit that consists mainly of a microprocessor. Those skilled in the art will therefore recognize that very little of the circuitry will be dedicated only to one function; most parts of the circuitry will ordinarily constitute parts of several of the means represented by the various blocks. Furthermore, if the device were to be realized in a "hard-wired" arrangement, it is clear that the various functions would not have to be segregated as they are in FIG. 5. FIG. 5 merely segregates the functions for ease of description and definition.

Block 82 of FIG. 5 represents the function of providing the randomizing influence on the various simulations. This is accomplished by producing three numbers determined by various time intervals that occur during game play. A first number, which will be referred to for the sake of convenience as random number A, is contained in a four-bit register. Accordingly, it can have one of sixteen possible values. Random number A is initially set to zero, but it begins being incremented at a high rate during the display of the score that precedes a new batter. Each time it reaches fifteen ($1111_2$), it is set back to zero and thus continuously cycles through its sixteen values. The rapid incrementation can be performed upon the occurrence of any repetitive function, such as the refreshing of the various display devices, and it continues until the offensive operator depresses the NB button. At that point, incrementing stops, and the number in the register at the time of depression of the NB key remains in the register until a new batter is simulated.

The incrementing of the register occurs at a very rapid rate in the preferred embodiment because it occurs as part of the routine carried out by the operational circuitry for refreshing the various LEDs and vacuum-fluorescent digits. The various display devices often appear to light simultaneously and continuously, but they are really actuated sequentially at a rate that is high enough to make them seem to be operated continuously and simultaneously. Random number A is thus incremented at a rate that is much too fast for any relationship between the time of button depression and the "random number" to be apparent to the operator. "Random number" A can therefore be thought of as random, although purists may differ on whether or not it is random in the strictest sense. Accordingly, the generation of these outcome-determining numbers is referred to as being performed in a "variable manner"; i.e., whether or not the numbers are strictly random, they do appear random to the user of the device.

A second random number, random number B, is also generated. Random number B is generated in a manner similar to that in which random number A is generated, but the B register is incremented between the time that the NB button is first depressed and the time when it is released. The final random number, random number C, is incremented between the time when LED 41 first lights up to either the time when swing button 34 is depressed or the time when the pitch simulation ends, whichever occurs first.

In operation, random numbers A and B are set when the NB key is depressed. Operational circuitry 96 then performs the function designated by "pitch simulation" block 80 in FIG. 5. The pitch is simulated at one of four fast speeds or at one of four slow speeds, depending on which group has been selected by the defensive operator. The determination of which among the four selected speeds is to be simulated on random numbers B and C. The two four-bit numbers B and C are added, and the most significant digit of the sum is discarded in order to leave a four-bit number. This truncated sum can have sixteen possible values, and each of the possible speeds is associated with four of the sixteen possible values of the sum. Therefore, each speed is equally likely.

Figure 6:
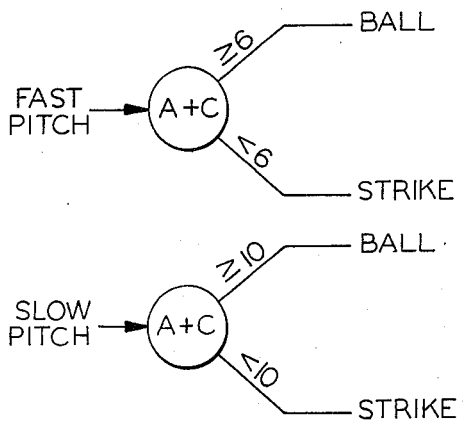
FIG. 6 is a decision diagram representing the determination of a pitch path.

The determination of whether the simulated ball is to follow a strike path or a ball path is also made in a variable manner. This determination which is diagrammed in FIG. 6, is based on the truncated sum of random numbers A and C. Again, the truncated sum can have one of sixteen possible values (0 to 15 in base 10). For a fast pitch, a strike path is simulated if the value of the sum is less than six. If the sum is six or more, a ball path is simulated. For a fast pitch, therefore, the chances of pitching a ball in the strike zone are six out of sixteen, while the chances of missing the strike zone are ten (sixteen minus six) out of sixteen.

If the defensive operator does not depress FAST PITCH key 22, a slow pitch results. The determination of whether the path is a ball path or a strike path is also made in accordance with the sum of random numbers A and C. For a slow pitch, though, the chances of hitting the strike zone are ten out of sixteen instead of six out of sixteen. Of course, the resultant chances of missing the strike zone are six out of sixteen.

Once the pitch is simulated, an outcome must be determined. Operational circuitry 96 detects the time at which the offensive operator depresses swing button 34. This function is represented by block 86 of FIG. 5. If the swing is within the "window" that occurs approximately at the time that LED 44 lights up, a batted ball results. This window occurs only if the ball has followed the strike path; if the ball path is followed, a strike results from a swing, and a ball results if the batter does not swing.

If it has been determined that a batted ball is to result, further steps must be taken before the outcome is determined unless, as was mentioned before, the offensive operator has chosen a bunt. This outcome determination is dependent upon the batting average of the current batter, the "random" number generated, and whether or not the offensive operator has chosen a power swing. As block 78 of FIG. 5 suggests, the operational circuitry contains information in the form of the batting average associated with each batter.

In order to determine the outcome of a batted ball, operational circuitry 96 keeps track of which probability data are to be employed in determining the outcome. This function is represented by block 90 in FIG. 5. The data to be employed are then used to generate a *comparison number,* the number that is to be compared to the "random" number in order to determine the outcome. This function is suggested by block 84. If an ordinary swing is to be simulated, probability generator 84 merely supplies this number for comparison with the appropriate "random" number. This comparison is represented by block 88.

Figure 7:
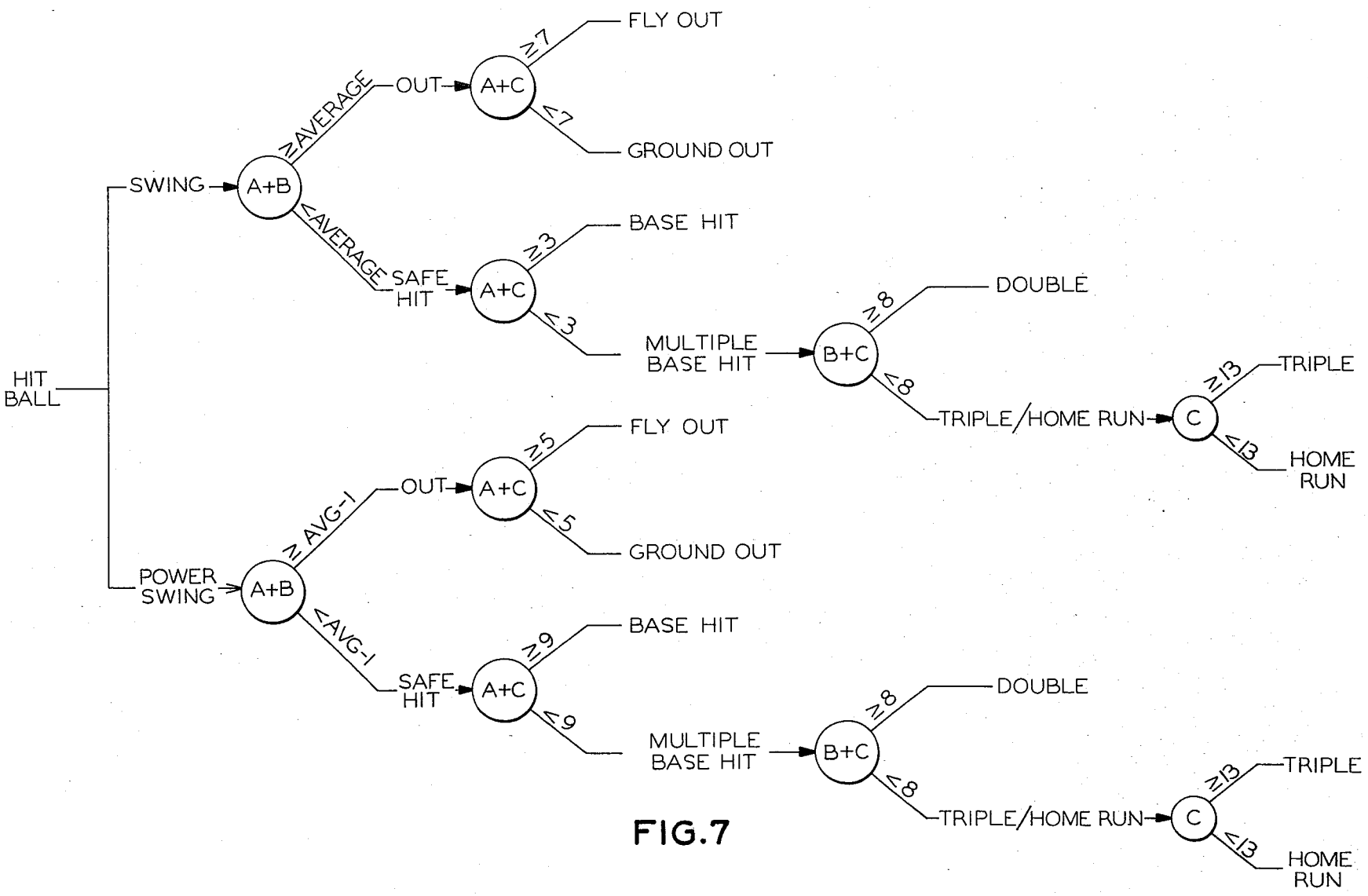
FIG. 7 is a similar diagram depicting the determination of the outcome of a batted ball.

As FIG. 7 indicates, random numbers A and B are added. The most significant bit of the sum is dropped to yield a four-bit number. This number is the "random" number used for comparison with the comparison value produced by the function of block 84. In the case of an ordinary swing, the comparison number for a 0.300 hitter will be $0111_2 (=7_{10})$, which means that he will hit safely if the truncated sum of A and B is less than seven, but an out will result if the sum is greater than or equal to seven. On the other hand, if the offensive operator depresses P switch 26, the number used for comparison will be one less than the probability data associated with the current batter. Thus, on a power swing, the comparison number will be $0110_2 (=6_{10})$, not $0111_2$, for a 0.300 hitter. This simulates the reduced accuracy that would typically be the result of swinging particularly hard in order to hit a long ball.

Once it has been determined whether the outcome of the batted ball is a hit or an out, a determination must be made of what type of hit or out is to be simulated. In the case of an out that results from an ordinary swing, the truncated sum of random numbers A and C is compared with the number seven, and the result is used, as indicated in FIG. 7, to determine whether a ground out or a fly out will result. Since the comparison number equals seven, a fly out is slightly more likely than a ground out. On the other hand, if the offensive operator had chosen a power swing, a fly out would be much more likely, since it would only require that the truncated sum of "random" numbers A and C be greater than or equal to three.

If it is determined that the batted ball has resulted in a safe hit, the outcome can branch through as many as three further comparisons. The first comparison employs random numbers A and C to determine whether the safe hit will be a base hit or a multiple base hit. As FIG. 7 indicates, the chance of obtaining a multiple base hit is only 3/16 if an ordinary swing is employed, while the chance of obtaining a multiple base hit is 9/16 for a power swing. Again, the difference in probabilities is intended to simulate a harder swing. Although a batter attempting a particularly hard swing can be expected to be less accurate, he is also more likely to hit a longer ball. Thus, a power swing results in a higher ratio of the probability of multiple base hits to ordinary base hits but a lower probability of obtaining a safe hit in the first place.

As FIG. 7 further indicates, random numbers B and C are employed to determine whether a multiple base hit will be a double or not, and random number C is employed to choose between a triple and a home run. Once the outcome has been determined, it is displayed as described previously.

The preceding functions can be summarized by reference to FIG. 5. The functions represented by blocks 78, 84 and 90 together establish probabilities for the possible outcomes of the simulated batter swing. These probabilities are dependent on the type of swing being simulated, and the probability that a simulated hit will result from an ordinary swing is greater than the probability that it will result from a power swing. On the other hand, the ratio of the probability of a simulated multiple base hit to that of a simulated base hit is greater for the power swing than for the ordinary swing.

Blocks 82 and 88 together provide the function of determining the outcome to be displayed. This outcome is dependent on the detected time during the simulated movement of the pitched ball when the simulated batter swinger occurs. During the time window, the outcomes are determined in accordance with the probabilities established by the functions represented by blocks 78, 84 and 90.

The operational circuitry can also be thought of as interpreting the random numbers as outcomes. Blocks 84 and 88 determine the outcome by interpreting outcome-determining numbers provided by the "random number" function 82 in a manner that depends both on the choice of batter swing and on the probability data generated by the functions of blocks 78 and 90.

FIG. 5 also reflects other functions that are provided by the operational circuitry. A status feature is suggested by block 76, which represents the function of keeping track of various items of status information, such as the positions of the base runners, the number of outs, which side is at bat, and so on. Signals conveying this information are among those represented by arrow 72.

Figure 8:
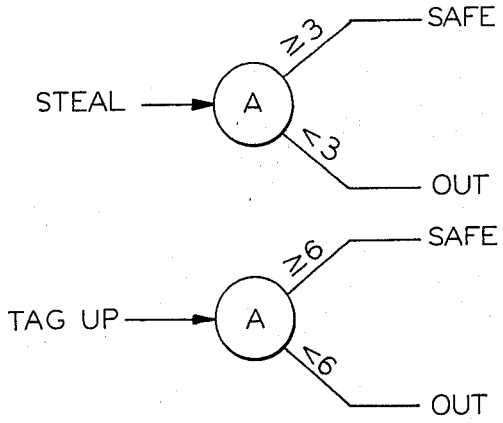
FIG. 8 is a similar diagram showing the determination of the outcome of a simulated attempt to steal or take a base after a fly out.

A final function depicted in FIG. 5 is the function, represented by block 74, of steal simulation. The steal probabilities are shown in FIG. 8. If the S button is depressed during the time when LED 41 is lit, an attempted steal is simulated if a batter is on base and the outcome is not a batted ball. The steal is unsuccessful, and the lead runner is thrown out, if a pitch along the ball path has been simulated. But if a pitch within the strike zone is simulated, random number A is compared with the comparison number, and an out results whenever random number A is less than three. If it is equal to or greater than three, a safe steal is simulated.

The "tag up" represents a special situation. This feature only comes into play if the batter has chosen a power swing and a fly out has resulted. In such an instance, this feature is brought into play if the batter depressed the S key during the time that the "FO" code is being displayed. When this occurs, an attempt to take a base after tagging up is simulated, but the probability of success is only 10/16, not the 13/16 probability used for the normal steal function.

It should be noted in connection with FIG. 7 that only the outcomes whose determinations involve probabilistic factors are displayed. For instance, the advancement of base runners that accompanies safe hits is not depicted in FIG. 7, because their advancement is fixed once the outcomes represented there have been determined. Base runners always advance the same number of bases as the hitter does unless the S key has been depressed, in which case each base runner other than the batter takes an extra base.

A double play is also not shown in FIG. 7, but a double play is simulated if the probability determination in FIG. 7 has resulted in a ground out and a man on base is in a "forced" condition. In such a case, all "forced" runners advance, but the two leading "forced" runners are thrown out, and runners not "forced" hold their bases. In the illustrated embodiment, a runner is *forced* if there are no empty bases between him and the batter. For example, if the bases are loaded, the runners starting at second and third are thrown out, while the batter and the runner starting at first safely take first and second bases, respectively. If there were only men on first and third, the "unforced" man on third would hold, while the batter and the runner starting on first would be thrown out. When a double play occurs, the code displayed, instead of being "GO" for ground out, is "dp" for double play.

A further outcome that is not depicted is that of a sacrifice bunt. When the B key is depressed and the batter swings within the time window at a ball that is in the strike path, all base runners advance on base, but the batter is out at first.

Figure 9A:
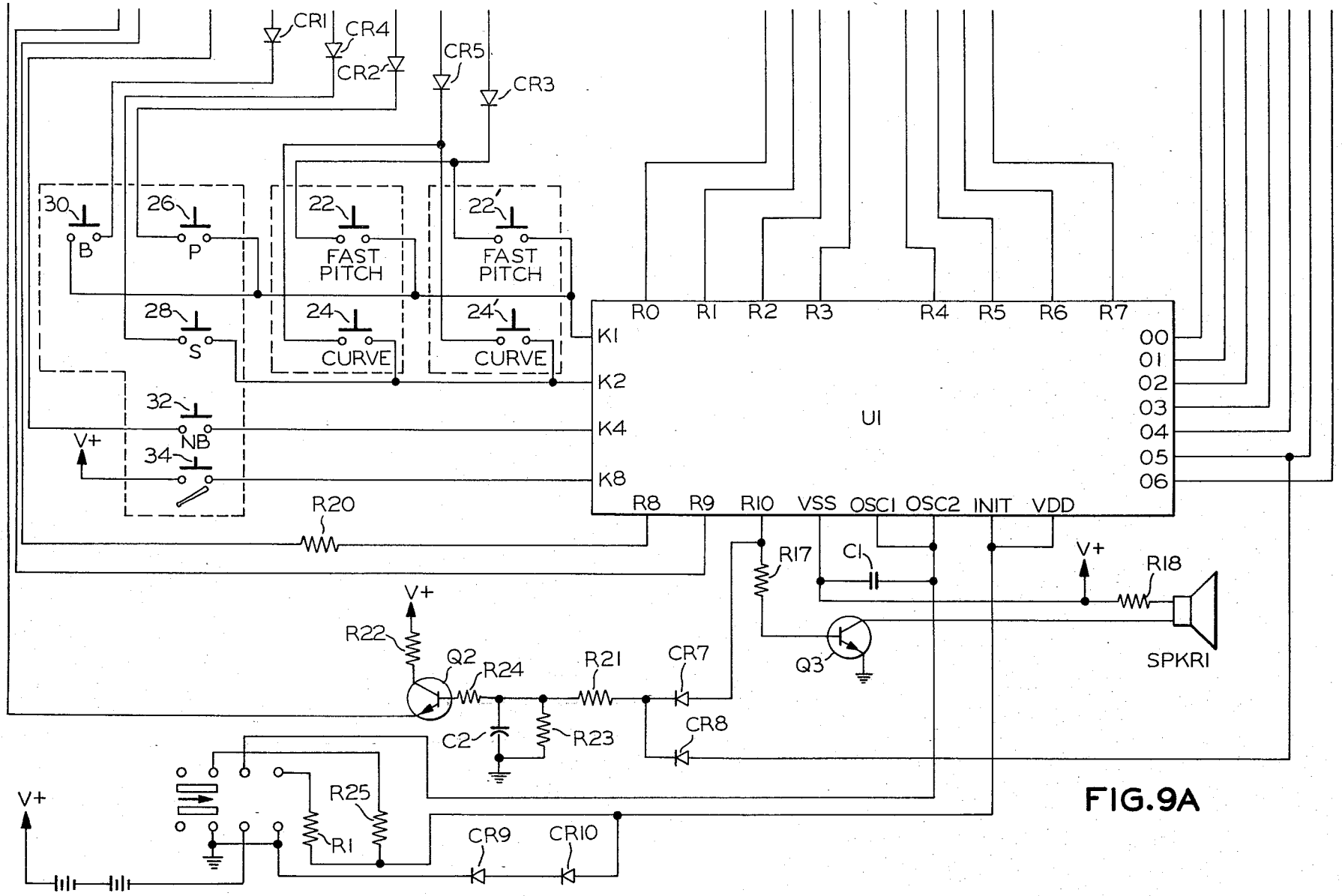
FIGS. 9A and 9B together constitute a schematic diagram of the electrical connections in the apparatus.
Figure 9B:
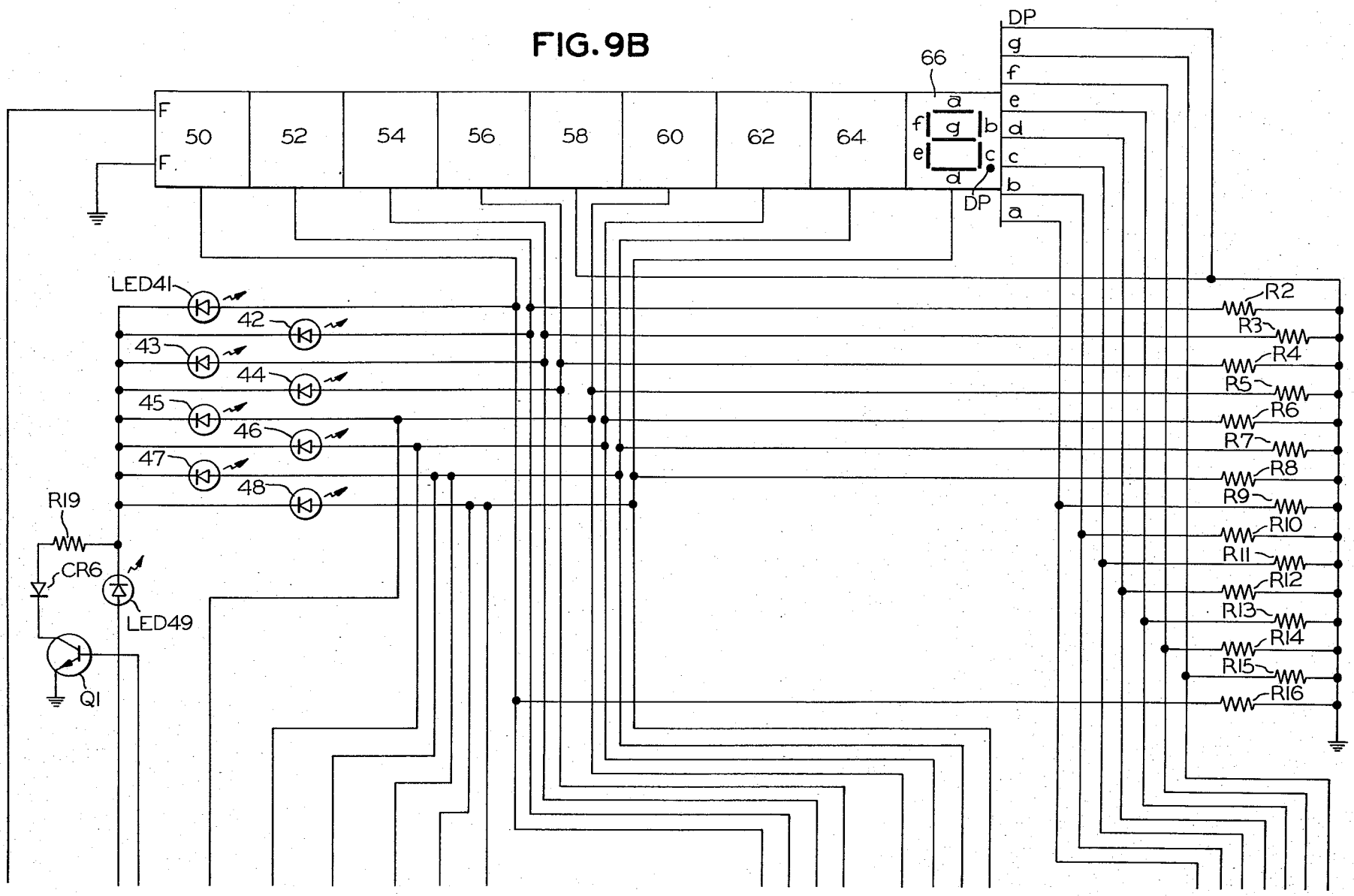

FIGS. 9A and 9B together constitute a schematic diagram of the circuit employed in the preferred embodiment of the present invention. U1 is a TMS 1170 microprocessor manufactured by Texas Instruments. It is provided with read-only memory in accordance with a computer program for carrying out the functions described above. The foregoing description of the functions to be performed will enable those skilled in the art to produce a program for the TMS 1170 or similar microprocessors that will carry out the functions described.

A detailed description of the circuitry will not be undertaken here because the basic wiring connections for the microprocessor will be recognized by those skilled in the art, while the wiring providing communication between the control board and the microprocessor and between the microprocessor and the display is not peculiar to the functions described; the interpretations given, to key depressions, for instance, depends on the program contained in the microprocessor.

FIGS. A and B constitute a single diagram in which the lines terminating at the top of FIG. 9A continue as correspondingly positioned lines terminating at the bottom of FIG. 9B. In FIG. 9A, on/off switch 14 is shown as a three-position switch. In the off position shown in FIG. 9A, no connections are made by switch 14. In the next position to the right, switch 14 connects the negative side of the battery circuit to ground, thereby applying power to the circuit. This position also connects resistor R25 across terminals OSC2 and INIT, thereby causing it to become part of the microprocessor's basic clock circuit. The position of switch 14 farthest to the right also connects the negative side of the battery circuit to ground, but it connects resistor R1, not R25, into the clock circuit. Resistor R1 results in a higher clock speed, and the rightmost position of switch 14 is thus the higher-skill position because all operations occur at a faster rate in that position.

A speaker SPKRI for providing the various audible signals is driven by transistor Q3, whose base is connected to terminal R10 of U1. When it is desired to play a tune or produce some other sound effect, pulses are produced by U1 at terminal R10 at the appropriate frequencies for the necessary durations.

The various control-board switches are also depicted in FIG. 9A, which shows them wired to enter signals into microprocessor U1. For example, swing key 34 enters a signal into terminal K8 of U1 by connecting it to the positive side of the battery circuit. As another example, it can be seen by following corresponding lines in FIGS. 9A and 9B that B switch 30 enters a signal by connecting terminals K1 and R5. By similar circuitry, the other switches also enter signals into microprocessor U1, and those skilled in the art will appreciate that U1 can be programmed to recognize the meanings of the various switch actuations.

FIG. 9B depicts the various display elements, LEDs 41 through 49 and vacuum-fluorescent digits 50 through 66. Vacuum-fluorescent digits 50 through 66 are driven in a matrix-type organization, in which digits 50 through 56 are activated by lines from terminals R0 through R3 of U1, while digits 60 through 66 are driven by lines from terminals R4 through R7 of U1. Each of the display digits has eight drivable elements, seven segments plus a decimal point. The various elements are only shown in display digit 66, which shows segments a through g as well as the decimal point. Although they are only shown in digit 66, all of the other digits, of course, also have these elements.

To the right of the symbols for the display are lines that have designations corresponding to the drivable elements shown in display digit 66. each of these lines is common to corresponding element in all the digits; the a line services all of the a segments, and the DP line services all of the decimal points. In order to light an element on a given digit, it is necessary to provide high signals at its segment and digit lines. For example, providing high signals from the O2 and R4 terminals of U1 to the c line and digit 60 of the display, respectively, will cause segment c of digit 60 to light up.

Reflection will reveal that this organization will not ordinarily permit all of the display digits to be activated simultaneously. Suppose, for instance, that it is desired to display an 8 in display digit 66 but a 1 in display digit 64. It is apparent that driving all the elements necessary to provide the 8 in display digit 66 will also cause an 8 to be displayed in digit 64 if the microprocessor terminals connected to both of these digits present high signals simultaneously. It is therefore necessary to drive the display digits sequentially. However, they are driven sequentially at a rate that is fast enough so that it appears that all of them are illuminated simultaneously.

Proper servicing of the vacuum-fluorescent display also requires that a filament be driven. In the version shown in FIGS. 9A and 9B, this function is performed by a transistor Q2, whose emitter is connected to one of the terminals F of the vacuum-fluorescent display. The other terminal F is tied to ground. It has been found that any message to be shown on the display will either include at least one f segment or will be accompanied by a signal from SPKR1. Accordingly, the O5 and R10 terminals, which drive the f segment and SPKR1, respectively, are ORed through diodes CR7 and CR8 to drive an RC network consisting of R21, R23 and C2 whose output is applied to the base of Q2 through R24. The RC network averages the pulses coming from the two sources and thereby provides a relatively steady base signal to Q2. As a result, a relatively steady filament current flows through the display filament when a message is to be displayed on the vacuum-fluorescent display.

Terminals R0 through R7, which are used to select vacuum-fluorescent display digits, are also used to drive LEDs 41 through 48. A high signal at terminal R7 of U1, for instance, will cause LED 48 to light if terminal R8 of U1 simultaneously provides a high signal to the base of Q1 to cause it to sink current from LED 41 through R19 and CR6. In order to light LED 49, simultaneous high signals at terminals R8 an R9 of U1 are required.

It is apparent from the foregoing description that a baseball game is disclosed that simulates batting in a particularly effective manner. By operation of the control-board keys, the offensive operator can simulate batter swings of different forces. The simulation cause effects of the different simulated swing types that are similar to those that would be expected in the real game.

Having thus described the invention, we claim:

1. In an apparatus for simulating a baseball game, the combination comprising:

a. a display panel including a visual simulation of a baseball field and adapted, upon application of electrical signals thereto, to display symbols including a ball symbol for simulating a ball and to indicate outcomes of simulated batter swings at the simulated ball, the possible outcomes including base hits and multiple base hits, the possible outcomes thereby including outcomes representing batted balls;

b. a control board including a multiplicity of manually operable control elements and operable by operation of at least one of said manually operable control elements to generate signals signifying simulated batter swings at said simulated ball, at least one of said control elements being manually operable to provide variation between generated signals indicative of a choice of the type of batter swing being simulated, said choice being between at least a normal type of batter swing and a power type of battery swing; and c. operational circuit means operatively connected to said display panel for generation and transmission of electrical signals to said display panel to display said ball symbol and indicate the outcome of simulated batter swings at the simulated ball, said operational circuit means being electrically connected to said control board for reception therefrom of the electrical signals signifying simulated batter swings at the simulated ball and indicating which type of batter swing is being simulated, said operational circuit means including:

(i) means for generating a signal to produce a ball symbol on the display panel and for moving the ball symbol along said simulated playing field to simulate a pitch;

(ii) means for detecting the time during the simulated movement of the pitched ball at which the swing-signifying signal is received;

(iii) means for establishing probabilities for the possible outcomes of the simulated batter swing, the probabilities being dependent on at least two modifying factors, one modifying factor upon which said probabilities are dependent being the probability data associated with the batter then at the plate and indicative of his predetermined batting average, another being the type of batter swing being simulated, the probability, if all other modifying factors are the same, that a simulated hit will result from the normal type of simulated batter swing always being greater than the probability that a simulated hit will result from the power type of simulated batter swing, the ratio, if all other modifying factors are the same, of the probability of a simulated multiple base hit to that of a simulated base hit being greater for the power type of simulated batter swing than for the normal type;

(iv) means for determining the outcome to be displayed on said display panel in response to signals from said operational circuit means, said determination being in a manner dependent on said probability data associated with the batter then at the plate, the type of swing selected, and the detected time during the simulated movement of the pitched ball when the simulated batter swing occurs, the outcome within at least a range of swing times being determined for at least some simulated batter swings in a variable manner in accordance with the probabilities established by said means for establishing probabilities; and (v) means for generating a signal to produce a batter symbol on said display panel at the simulated home plate position of said simulated playing field and thereafter responsive to said outcome determining means to produce a runner symbol at a selected one of the bases on the simulated playing field if a hit or a walk is determined or the batter symbol at the home plate if a strike or a ball is determined.

2. The apparatus of claim 1 wherein:

a. the possible outcomes of simulated batter swings also include outcomes representing other than batted balls;

b. said means for detecting swing times establishes a time window within the time of the simulated movement of the pitched ball and determines whether the swing-signifying signal is received during said time window; and c. said outcome-determining means determines outcomes representing batted balls only if the swing-signifying signal is detected by said swing-detecting means during said time window.

3. The apparatus of claim 2 wherein:

a. said means for moving said ball symbol to simulate the pitch includes means for moving said ball symbol along at least one simulated strike path and means for moving said ball symbol along at least one simulated ball path; and b. said outcome-determining means determines outcomes representing batted balls only when said means for moving said ball symbol moves said ball symbol along a simulated strike path.

4. The apparatus of claim 3 wherein said means for moving the ball symbol to simulate a pitch is operable to select from among said simulated strike and ball paths in a variable manner.

5. The apparatus of claim 4 wherein:

a. said control board is operable by operation of at least one of said manually operable control elements to generate and transmit to said operational circuit means a signal representing the selection of a given one of said simulated strike and ball paths; and b. said means for moving said ball symbol to simulate a pitch moves said ball symbol to simulate said given one of said simulated strike and ball paths in response to receipt by said operational circuit means of said signals from said control board representing the selection of said given one of said simulated strike and ball paths.

6. The apparatus of claim 1 wherein:

a. said display panel is adapted, upon application of electrical signals thereto, to display symbols to represent the positions of base runners on said simulated baseball field;

b. said control board is operable by operation of at least one of said manually operable control elements to generate and transmit to said operational circuit means signals representing steal commands; and c. said operational circuit means generates and transmits to said display panel electrical signals to display symbols to represent the positions of base runners on said simulated baseball field and further includes steal means operable upon reception by said operational circuit means of said signals representing steal commands to determine whether a successful steal is to be simulated and to advance the position of a simulated base runner on said simulated baseball field when it has determined to simulate a successful steal.

7. The apparatus of claim 6 in which said steal means determines whether the simulated steal is successful in a variable manner in at least some play situations.

8. The apparatus of claim 6 wherein:

a. at least one of the possible outcomes of simulated batter swings includes a simulated fly out; and b. said steal means includes means for establishing a time window in at least some play situations when a fly out has been indicated and for simulating an attempt to take a base if said operational circuit means receives said signal from said control board representing an attempt to take a base within said time window established by said steal means.

9. In an apparatus for simulating a baseball game, the combination comprising:

a. a display panel including a visual simulation of a baseball field and adapted, upon application of electrical signals thereto, to display symbols including a ball symbol for simulating a ball, to indicate outcomes of simulated batter swings at the simulated ball, and to display a representation of probability data associated with a simulated batter whose turn at bat is currently being simulated;

b. a control board including a multiplicity of manually operable control elements and operable by operation of at least one of said manually operable control elements to generate signals signifying simulated batter swings at the simulated ball, at least one of said control elements being manually operable to provide a variation between generated signals indicative of a choice of the type of batter swing being simulated, said choice being between at least a normal type of batter swing and a power type of batter swing; and c. operational circuit means operatively connected to said display panel for generation and transmission of electrical signals to said display panel to display said ball symbol, to display a representation of probability data associated with the simulated batter whose turn at bat is currently being simulated, and to indicate the outcomes of simulated batter swings at said simulated ball, said operational circuit means being electrically connected to said control board for reception therefrom of said electrical signals signifying simulated batter swings and indicating which type of batter swing is being simulated, said operational circuit means including:

(i) memory circuit means containing probability data associated with a plurality of batters to be simulated, said memory circuit means having at least first distinct probability data associated with one portion of said plurality of batters and second distinct probability data associated with another portion of said plurality of batters with each said portion comprising at least one batter;

(ii) means for designating the one among said plurality of simulated batters whose turn at bat is to be simulated and a representation of whose probability data is to be displayed:

(iii) means for generating a signal to produce a ball symbol on the display panel and for moving the ball symbol along said simulated playing field to simulate a pitch;

(iv) means for detecting the time during the simulated movement of the pitched ball at which the swing-signifying signal is received;

(v) number-generating means for establishing at least one outcome-determining numerical value in a variable manner;

(vi) means for establishing probabilities for the possible outcomes of the simulated batter swing, the probabilities being dependent on at least two modifying factors, one modifying factor upon which said probabilities are dependent being the probability data associated with the batter then at the plate and indicative of his predetermined batting average, another being the type of batter swing being simulated, the probability, if all other modifying factors are the same, that a simulated hit will result from the normal type of simulated batter swing always being greater than the probability that a simulated hit will result from the power type of simulated batter swing, the ratio, if all other modifying factors are the same, of the probability of a simulated multiple base hit to that of a simulated base hit being greater for the power type of simulated batter swing than for the normal type;

(vii) means for determining the outcome to be displayed on said display panel, the determination being made in a manner dependent at least on the detected time during the simulated movement of the pitched ball at which the swing-signifying signal is received, the outcome within at least a range of swing times being determined for at least some simulated batter swings by interpreting at least one of said outcome-determining numerical values as the outcome of the currently simulated batter swing, the interpretation of said outcome-determining numerical value depending at least upon the choice of batter swing and on said probability data associated with the simulated batter whose turn at bat is currently being simulated; and (viii) means for generating a signal to produce a batter symbol on said display panel at the simulated home plate position of said simulated playing field and thereafter responsive to said outcome determining means to produce a runner symbol at a selected one of the bases on the simulated playing field if a hit or a walk is determined or the batter symbol at the home plate if a strike or a ball is determined.

10. The apparatus of claim 9 wherein said outcome-determining means establishes a comparison numerical value equal to the probability data associated with the simulated batter whose turn at bat is currently being simulated when a first type of batter swing has been chosen and differing from said probability data by a predetermined amount when at least one other type of batter swing has been chosen, said outcome-determining means comparing said comparison numerical value to said outcome-determining numerical value, selecting between sets of outcomes based on the difference between said comparison numerical value and said outcome-determining numerical value, and interpreting said outcome-determining numerical value as one of the outcomes of the selected set.

11. The apparatus of claim 9 wherein said pitch-simulating means moves said ball symbol along said simulated playing field at a speed chosen from among a plurality of speeds in accordance with at least one number generated by said number-generating means.

12. The apparatus of claim 11 wherein:

a. said control board is operable by operation of at least one of said manually operable control elements to generate and transmit speed-selection signals to said operational circuit means to select from among sets of said speeds for simulating pitches; and b. said pitch-simulating means selects a pitch speed from the set of pitch speeds selected by said speed-selection signals from said control board.

13. A method of electrically simulating a baseball game comprising the steps of:

a. providing a display panel including a visual simulation of a baseball field and adapted, upon application of electrical signals thereto, to display symbols including a ball symbol for simulating a ball, to display a representation of probability data associated with a simulated batter selected from among a plurality of batters to be simulated, and to indicate outcomes of simulated batter swings at the simulated ball;

b. providing memory circuit means containing probability data associated with a plurality of batters to be simulated;

c. designating one among said plurality of batters to be simulated as the one whose turn at bat is currently to be simulated;

d. generating and transmitting to said display panel electrical signals to display on said display panel a representation of the probability data associated with the batter whose turn at bat is currently being simulated;

e. generating and transmitting electrical signals to said display panel to display a batter symbol at the simulated home plate and a ball symbol and to move said ball symbol along said simulated playing field to simulate a pitch;

f. selecting a type of swing from a group of swings including a normal swing and a power swing;

g. electrically signifying the occurrence of a simulated batter swing and the selection of the type of swing being simulated;

h. detecting the time during the simulated movement of the pitched ball at which the simulated swing is electrically signified;

i. establishing at least one outcome-determining numerical value in a variable manner;

j. determining the outcome of said simulated batter swing in a manner dependent at least on the probability data associated with the batter then at the plate, the type of swing selected, and the detected time during the simulated movement of the pitched ball at which the simulated batter swing is electrically signified, the outcome within at least a range of swing times being determined by interpreting at least one outcome-determining numerical value as the outcome of the selected simulated batter swing, said interpretation depending at least on both the choice of batter swing and said probability data associated with the simulated batter whose turn at bat is currently being simulated; and k. generating and transmitting signals to said display panel to produce, responsive to said outcome determining means, a runner symbol at a selected one of the bases on the simulated played field if a hit or a walk is determined or the batter symbol at the home plate if a strike or a ball is determined.

14. The method of claim 13 wherein:

a. said outcomes that said display panel is adapted to display include outcomes representing a batted ball;

b. the step of detecting the swing time includes establishing a time window within the pitch simulation and determining whether the simulated swing is electrically signified during said time window; and c. said outcome-determining step includes determining an outcome representing a batted ball only when the swing time occurs within said time window.

15. The method of claim 14 wherein at least said step of generating and transmitting signals to said display panel to simulate a pitch is performed a plurality of times and includes simulating a pitch at least once along a simulated strike path and at least once along a simulated ball path, and wherein said outcome-determining step includes determining an outcome representing a batted ball only when a pitch is simulated along a simulated strike path.

16. A method of electrically simulating a baseball game comprising the steps of:

a. providing a display panel including a visual simulation of a baseball field and adapted, upon application of electrical signals thereto, to display symbols including a ball symbol for simulating a ball, to display a representation of probability data associated with a simulated batter selected from among a plurality of batters to be simulated, and to indicate outcomes of simulated batter swings at the simulated ball, said outcomes include representing a batted ball;

b. providing memory circuit means containing probability data associated with a plurality of batters to be simulated;

c. designating one among said plurality of batters to be simulated as the one whose turn at bat is currently to be simulated;

d. generating and transmitting to said display panel electrical signals to display on said display panel a representation of the probability data associated with the batter whose turn at bat is currently being simulated;

e. generating and transmitting electrical signals to said display panel to display a ball symbol and to move said ball symbol along said simulated playing field to simulate a pitch;

f. electrically signifying the occurrence of a simulated batter swing and a choice of the type of swing being simulated with at least a first type and a second type of swing;

g. detecting the time during the simulated movement of the pitched ball at which the simulated swing is electrically signified by establishing a time window within the pitch simulation and determining whether the simulated swing is electrically signified during said time window;

h. establishing at least one outcome-determining numerical value in a variable manner;

i. determining the outcome of said simulated batter swing in a manner dependent at least on the detected time during the simulated movement of the pitched ball at which the simulated batter swing is electrically signified, the outcome within at least a range of swing times being determined by interpreting at least one outcome-determining numerical value as the outcome of the simulated batter swing, said interpretation depending at least on both the choice of batter swing and said probability data associated with the simulated batter whose turn at bat is currently being simulated, said step of determining the outcome of said simulated batting swing includes determining an outcome representing a batted ball only when the swing time occurs within said time window;

said step of determining the outcome includes:

(i) establishing a comparison numerical value that is equal to said probability data associated with the simulated batter whose turn at bat is currently being simulated if said first swing type is chosen, said comparison numerical value being equal to a numerical value differing by a predetermined amount from said probability data associated with the currently simulated batter if said second swing type is chosen;

(ii) dividing said possible outcomes of a batter swing that represent a batted ball into first and second sets;

(iii) comparing said comparison numerical value with said outcome-determining numerical value; and (iv) selecting an outcome from said first set of outcomes if a given one of said comparison and outcome-determining numerical values is greater than the other and selecting an outcome from said second set if it is not; and j. generating and transmitting signals to said display panel to display the determined outcome.

* * * * *